US009003841B2

(12) United States Patent
Koh

(10) Patent No.: US 9,003,841 B2
(45) Date of Patent: Apr. 14, 2015

(54) LEVER TYPE HANDLE AND LOCK ASSEMBLY FOR THE SAME

(76) Inventor: Youngkyun Koh, Seoul (KR)

( * ) Notice: Subject to any disclaimer, the term of this patent is extended or adjusted under 35 U.S.C. 154(b) by 0 days.

(21) Appl. No.: 14/123,225

(22) PCT Filed: May 31, 2012

(86) PCT No.: PCT/KR2012/004280

§ 371 (c)(1),
(2), (4) Date: Dec. 1, 2013

(87) PCT Pub. No.: WO2012/165866

PCT Pub. Date: Dec. 6, 2012

(65) Prior Publication Data

US 2014/0130557 A1 May 15, 2014

(30) Foreign Application Priority Data

Jun. 3, 2011 (KR) ..... 10-2011-0053617

(51) Int. Cl.

| | |
|---|---|
| ***E05B 59/00*** | (2006.01) |
| ***E05B 13/10*** | (2006.01) |
| ***E05B 15/00*** | (2006.01) |
| ***E05B 53/00*** | (2006.01) |
| ***E05B 1/00*** | (2006.01) |
| ***E05B 17/04*** | (2006.01) |
| ***E05B 13/00*** | (2006.01) |

(52) U.S. Cl.

CPC ..... *E05B 15/00* (2013.01); *E05B 53/003* (2013.01); *E05B 1/003* (2013.01); *E05B 17/041* (2013.01); *E05B 13/00* (2013.01)

(58) Field of Classification Search

CPC ..... E05B 15/00; E05B 13/00

USPC ..... 70/224, 86, 91, 107, 192, 182, 256, 70/257, 201, 207, 209, 210, 215, 216, 49, 70/379 R, 379 A, 380, 292, 298, 359, 217, 70/221; 403/228, 225, 221, 298, 372; 292/336.3, 347, 348, DIG. 38, 1

See application file for complete search history.

(56) References Cited

U.S. PATENT DOCUMENTS

| | | | | |
|---|---|---|---|---|
| 4,636,106 | A * | 1/1987 | Waisbrod | 403/228 |
| 4,921,289 | A | 5/1990 | Shen | |
| 6,543,265 | B1 * | 4/2003 | Fan | 70/224 |

(Continued)

FOREIGN PATENT DOCUMENTS

| | | | |
|---|---|---|---|
| EP | 0508018 | A1 | 10/1992 |

(Continued)

OTHER PUBLICATIONS

Translation of FR1175848, 1959.*

*Primary Examiner* — Lloyd Gall
*Assistant Examiner* — Amanda L Miller
(74) *Attorney, Agent, or Firm* — Novick, Kim & Lee, PLLC; Jae Youn Kim

(57) ABSTRACT

A lock assembly for a lever type handle is disclosed. In the lock assembly for the lever type handle according to an aspect to the invention, the lever type handle is for opening and closing a door by a rotation of a handle portion. The lock assembly includes a key module rotated by a key member, wherein the key module being positioned in the handle portion, a rotary shaft rotated by a rotation of the key module and locking or unlocking the door through a dead lock member, and a rotation transmitter for transmitting the rotation of the key module to the rotary shaft.

10 Claims, 8 Drawing Sheets

(56) References Cited

U.S. PATENT DOCUMENTS

| | | | | |
|---|---|---|---|---|
| 7,357,010 | B1 * | 4/2008 | Huang et al. | 70/379 R |
| 2003/0019257 | A1 | 1/2003 | Simon et al. | |
| 2007/0182167 | A1 * | 8/2007 | Garofoli | 292/336.3 |

FOREIGN PATENT DOCUMENTS

| | | | |
|---|---|---|---|
| FR | 1175848 | * | 4/1959 |
| KR | 20-1995-0019104 | U | 7/1995 |
| WO | 2004/104331 | A1 | 12/2004 |

* cited by examiner

LEVER TYPE HANDLE AND LOCK ASSEMBLY FOR THE SAME

TECHNICAL FIELD

The invention relates to a lever type handle and a lock assembly for the same.

BACKGROUND ART

Recently, as an interest in interior design increases, a shape of a handle is also diversified. Among handles of various types, a lever type handle is convenient, and has an excellent appearance. Therefore, the lever type handle is used for various doors, such as, a door of a room, a window, a front door, and so on.

A lever type handle basically opens and closes a door, and, additionally locks the door by preventing the rotation of the lever type handle or by using a dead lock member such as a dead bolt. For this, a key way or a hole wherein an additional key is inserted is formed at a peripheral portion of the lever type handle or a front surface of the lever type handle.

However, since the key way or the hole is formed at the peripheral portion of the lever type handle or the front surface of the lever type handle, a large area is necessary to perform an assembly and a process for mounting the lever type handle, and it makes an ill appearance. Also, in order to change the structure with the key to the structure without the key, to change the structure without the key to the structure with the key, or to change a type of the key, a whole portion of the lever type handle should be disassembled, a key-inserted portion should be replaced, and the whole portion of the lever type handle should be re-assembled. Thus, it is inconvenient to change the structure with the key to the structure without the key, to change the structure without the key to the structure with the key, or to change the type of the key. In addition, shapes of the lever type handles are different whether the key is used or not and according to the types of the keys, along with the basic function for opening and closing the door, and thus, the handles cannot have the uniform appearances.

DISCLOSURE

Technical Problem

The invention provides a lever type handle and a lock assembly for the same being able to have a simple structure and to be used for many purposes.

Technical Solution 2b

In a lock assembly for a lever type handle according to an aspect of the invention, the lever type handle is for opening and closing a door by a rotation of a handle portion. The lock assembly includes a key module rotated by a key member and positioned in the handle portion, a rotary shaft rotated by a rotation of the key module and locking or unlocking the door through a dead lock member, and a rotation transmitter for transmitting the rotation of the key module to the rotary shaft.

The key module may be positioned at an end portion of the handle portion.

An insertion direction of the key member may be parallel to a longitudinal direction of the handle portion.

The rotation transmitter may include a flexible shaft.

The handle portion may be bent, and the rotation transmitter may be bent to correspond to the handle portion in the handle portion.

The rotation transmitter may have a suspended portion where the rotary shaft is suspended at an end portion of the rotation transmitter.

The dead lock member may be protruded from or inserted in the door by the rotation of the rotary shaft, or the dead lock member may prevent the rotation of the lever type handle.

The key module may include at least one of a key way, a groove for a coin, and a grip portion at a surface of the key module exposed to an outside.

The lock assembly may further include a fixing portion where the rotation transmitter is fixed, and the fixing portion is positioned between the rotation transmitter and the key module. The fixing portion includes a groove having protrusions and indentations at an inner surface of the fixing portion, and the rotation transmitter is fixed to the groove of the fixing portion.

The key module may include a depressed portion where the fixing portion is coupled by an interference fit or a tight fit.

The lock assembly may be used on a hinged door or a sliding door.

The key module may have a cylinder shape.

A lever type handle according to another aspect of the invention includes a handle structure positioned outside a door, the handle structure including a housing portion mounted adjacent to a door and a handle portion including a first handle portion rotatably coupled to the housing portion and a second handle portion connected to the first handle portion through a bent portion, and a lock assembly for opening and closing the door by an operation of the handle portion. The lock assembly includes a key module rotated by a key member, the key module being positioned at and end portion of the second handle portion, and a rotary shaft rotated by a rotation of the key module and locking or unlocking the door through a dead lock member, a rotation transmitter for transmitting the rotation of the key module to the rotary shaft.

The key module may be positioned at an end portion of the handle portion.

An insertion direction of the key member may be parallel to a longitudinal direction of the handle portion.

The rotation transmitter may include a flexible shaft.

The handle portion may be bent, and the rotation transmitter may be bent to correspond to the handle portion in the handle portion.

Advantageous Effects

According to an embodiment of the invention, a key module is positioned inside a handle portion, and thus, an additional hole for installing the key module is not formed in a window or a door. Since the key module is not exposed to the outside and is not shown from the front of the door, the appearance of a lever type handle is excellent. Also, the key module is positioned at an end portion of the handle portion, and therefore, the key module can be easily operated by a user through using a key member.

Further, a structure of the lock assembly is simplified to the key module, a rotation transmitter, and a rotary shaft. Accordingly, a number of components can be reduced, and the manufacturing cost can be decreased. In addition, it is convenient to assemble and disassemble the lock assembly.

Furthermore, by unifying shapes of the key modules, a key module having a key way, a key module having a groove for a coin, or a key module having a grip portion can be freely selected. Also, when the key module is not necessary, a finishing module can be used instead of the key module. That is, the key module and/or the finishing module can be variously applied according to user's taste, a location of a door, and a usage of the door. Therefore, the user can can select the key module or the finishing module for various purposes, and productivity of the doors with the key module or finishing module can be enhanced.

In addition, the lock assembly or the lever type handle including the lock assembly can be freely applied to various types of doors, such as a hinged door, a sliding door, and so on.

DETAILED DESCRIPTION OF THE EMBODIMENTS

Hereinafter, a lever type handle including a lock assembly according to an embodiment of the invention will be described in detail.

Figure 1:
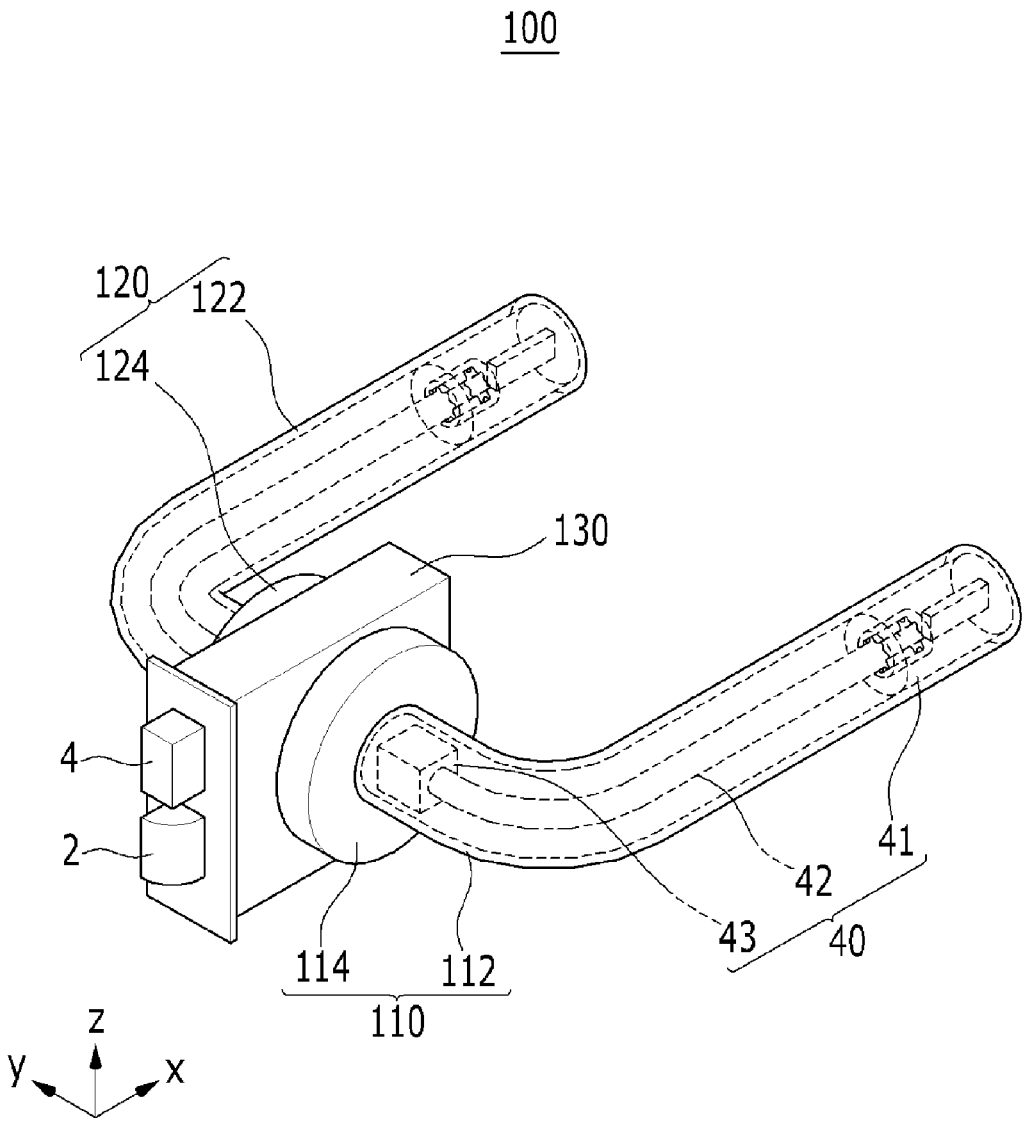
FIG. 1 is a perspective view of a lever type handle having a lock assembly according to a first embodiment of the invention.
Figure 2:
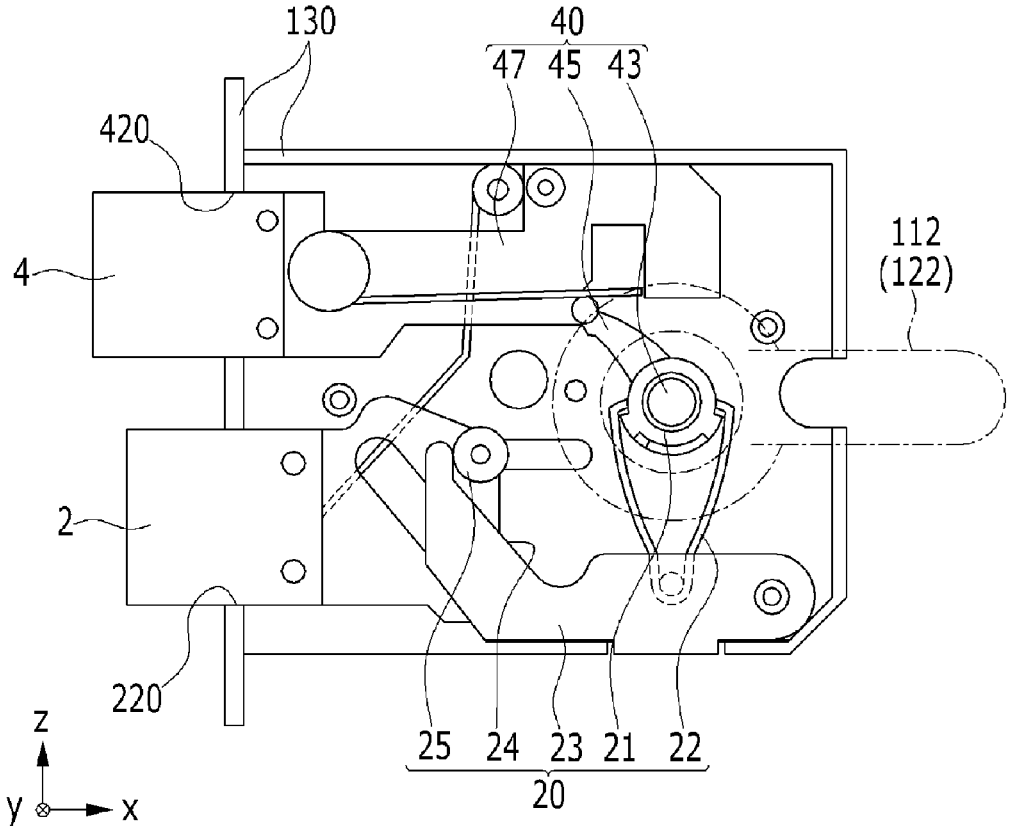
FIG. 2 is a schematic view for illustrating an example of a structure of the lock assembly for the lever type handle shown in FIG. 1.

FIG. 1 is a perspective view of the lever type handle having the lock assembly according to a first embodiment of the invention, and FIG. 2 is a schematic view for illustrating an example of a structure of the lock assembly for the lever type handle shown in FIG. 1.

With reference to FIG. 1 and FIG. 2, a lever type handle 100 having a lock assembly according to the embodiment of the invention includes handle structures 110 and 120 positioned at both sides of a door (not shown) to be operated by a user, and a case portion 130 is positioned between the handle structures 110 and 120. Lock assemblies 20 and 40 are positioned inside each of the handle structures 110 and 120 so that the door is opened and closed by the user through the operation of the handle structures 110 and 120.

The handle structures 110 and 120 include housing portions 114 and 124 installed to be adjacent to the door by fixing members(not shown) such as bolts and handle portions 112 and 122 rotatably coupled, respectively.

The case portion 130 is installed inside the door. In the case portion 130, a latch member 2, a dead lock member 4, and so on are positioned. The door is opened or closed by the latch member 2 and/or the dead lock member 4 protruded from the door or inserted in the door. For example, a latch bolt is used for the latch member 2. A dead lock member protruding outside the door, such as a dead bolt, or a dead lock member for preventing a rotation of the handle portion 112 or 122 is used for the dead lock member 4. In the embodiment, the latch bolt is used for the latch member 2, and the dead bolt is used for the dead lock member 4.

In the embodiment, the lock assemblies 20 and 40 include a latch lock assembly 20 and a dead lock assembly 40. The latch lock assembly 20 makes the latch member 2 be protruded from the door or be inserted in the door by a rotation of the handle portion 112 or 122. The dead lock assembly 40 makes the dead lock member 4 be protruded from the door or be inserted in the door by an operation of a key module 41, which is installed at an end portion of the handle portion 112 or 122.

More specifically, the latch lock assembly 20 makes the latch member 2 be protruded from or be inserted in the door by the rotation of the handle portion 112 or 122.

In a normal state, the latch member 2 protrudes from the door to penetrate through an opening 220 for the latch member 2 of the case portion 130. Thus, the latch member 2 is fixed to a receiving hole (not shown) of a doorpost (not shown). Hereby, the door is prevented from being open by wind or a weak concussion.

When the user rotates the handle portion 112 or 122 by an angular motion of a cam 21 connected to the handle portion 112 or 122, a connection lever 22 connected to the cam 21 activates or actuates a latch slider 23. Since a cam 24 for a slant move is formed at a side of the latch slider 23, a latch guide pin 25 connected to the cam 24 moves. And then, the latch member 2 is inserted inside the case portion 130. In this state, the user can open and close the user door.

In the embodiment, the latch lock assembly 20 includes the cam 21, the connection lever 22, the latch slider 23, the cam 24, and the latch guide pin 25 to operate the latch member 2, as an example. However, the present invention is not limited thereto. Thus, the latch member 2 may be operated by well-known various structures.

Also, the dead lock assembly 40 makes the dead lock member 4 be protruded from or inserted into the door by the key module 41 installed at the end portion of the handle portion 112 or 122.

More particularly, the rotation force of the key module 41 can be transmitted to the rotary shaft 43 through a rotation transmitter 42, and a connection lever 45 connected to the rotary shaft 43 moves a dead lock slider 47. By the movement of the dead lock slider 47, the dead lock member 4 can be protruded to penetrate through an opening 420 for the dead lock member 4 of the case portion 130 or can be inserted in the case portion 130. In the state that the dead lock member 4 is protruded to penetrate through the opening 420 for dead lock member 4, the door is kept closed by the dead lock member 4.

In the embodiment, the dead lock assembly 40 operates the dead lock member 4 by using the connection lever 45 and the dead lock slider 47, as an example. However, the present invention is not limited thereto. Thus, the dead lock member 4 may be operated by well-known various structures. That is, it is enough to have the key module 41, the rotation transmitter 42, and the rotary shaft 43 in the embodiment, and various structures for moving the dead lock member 4 by the rotary shaft 43 may be used.

Figure 3:
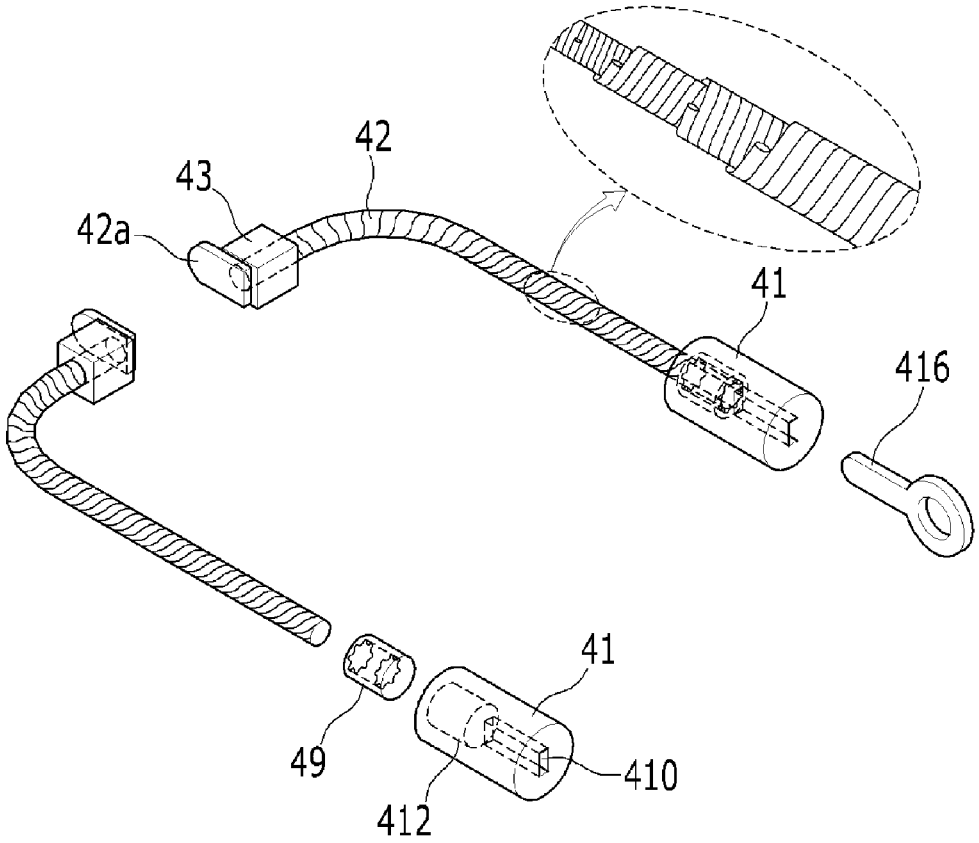
FIG. 3 is a perspective view of the lock assembly for the lever type handle according to the first embodiment of the invention.
Figure 4:
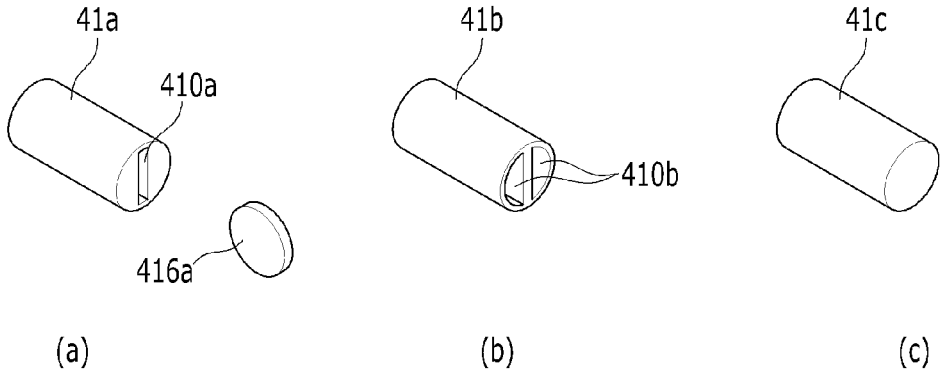
FIG. 4 is a perspective view of various modified embodiments of a key module in the lock assembly for the lever type handle according to the first embodiment of the invention.

With reference to FIG. 3, along with FIG. 1, the dead lock assembly 40 including the key module 41, the rotation transmitter 42, the rotary shaft 43, and so on will be described in more detail. FIG. 3 is a perspective view of the lock assembly for the lever type handle according to the first embodiment of the invention, and FIG. 4 is a perspective view of various modified embodiments of the key module in the lock assembly for the lever type handle according to the first embodiment of the invention.

Referring to drawings, the dead lock assembly 40, which is the lock assembly for the lever type handle according to the embodiment, may include the key module 41, the rotation transmitter 42, and the rotary shaft 43. Also, a fixing portion 49 may be further positioned between the key module 41 and the rotation transmitter 42.

In the embodiment, the key module 41 is rotatably installed inside the handle portion (112 or 122 of FIG. 1). More particularly, an inner portion of each of the handle portions 112 and 122 is vacant, and an end portion of each of the handle portions 112 and 122 is open. The key modules 41 are positioned at the open end portions of the handle portions 112 and 122, respectively. The key modules 41 are formed to correspond to an inner shape of the handle portions 112 and 122, respectively. For example, each of the handle portions 112 and 122 has a cylinder shape.

The key module 41 is formed of at least one of various materials having high productivity and having high strength so that it cannot be damaged by repeated operations. For example, the key module 41 may be formed of metal, plastic, and so on.

A key way 410 is formed at an outer surface of the key module 41 exposed through the open end of the handle portion 112 or 120 so that a key 416 can be inserted. In the embodiment, it is exemplified that the key 416 is used as a key module for rotating the key module 41. In the invention, the key member indicates all structures, components, and types being able to rotate the key module 41.

Therefore, as shown in (a) of FIG. 4, a groove 410*a* for a coin 416*a* is formed, and the key module 41 may be rotated by the coin 416*a* inserted into the groove 410*a*. Selectively, as shown in (b) of FIG. 4, the grip portions 410*b* are formed at both sides of the outside surface of the key module 41*b*. The user may insert fingers into the grip portions 410*b* and rotate the key module 41*b*. In (b) of FIG. 4, it is shown that the grip portions 410*b* have grooves or concave shapes so that the user's finger can be inserted. Contrary to this, the grip portions 410*h* have extruded shapes.

Also, when the locking by the dead lock member 4 is not necessary in the lever type handle, a finishing module 41*c* having a flat outside surface may be used instead of the key module 41, as shown in (c) of FIG. 4.

In the embodiment, the key module 41*b* is positioned at the end portion of the handle portion 112 or 122, and thus, the insertion direction of the key 416 is parallel to a longitudinal direction of the handle portion 112 or 122. That is, it is different from the prior art in which the longitudinal direction of the handle portion 112 or 122 crosses the insertion direction of the key 416.

Also, a depressed portion (or a recess portion) 412 may be formed at an inner surface opposite to the outer surface of the key module 41. The fixing portion 49 is fixed in the depressed portion 412 by an interference fit or a tight fit, and the rotation transmission 42 is fixed to the fixing portion 49. Then, the key module 41 and the rotation transmitter 42 are firmly and stably fixed to each other, and thus, the rotation of the key module 41 can be transmitted to the rotary shaft 43.

For example, the fixing portion 49 may be a spline. As shown in drawings, grooves having protrusions and/or indentations are formed at the fixing portion 49. Therefore, the fixing portion 49 can firmly and stably be fixed to an outer surface of the rotation transmitter 42. However, the invention is not limited thereto. Selectively, the rotation transmitter 42 may be directly fixed to the key module 41 without the fixing portion 49.

Various structures for transmitting the rotation of the key module 41 may be applied to the rotation transmitter 42. A flexible shaft that can change the axis direction may be used for the rotation transmitter 42. For example, the flexible shaft may be formed by winding a thin wire several times to have a coil or spring shape in order to change the axis direction. Therefore, the rotation transmitter 42 can transmit the rotation of the key module 41 to the rotary shaft 43, and can be installed in the handle portion 112 or 122.

A suspended portion 42*a* is formed at an end portion of the rotation transmitter 42 adjacent to the rotary shaft 43, and the rotary shaft 43 can be fixed to the suspended portion 42*a*. Then, the rotation transmitter 42 and the rotary shaft 43 can be firmly and stably fixed to each other.

In the lever type handle, each of the handle portions 112 and 122 is bent, each of the rotation transmitters 42 positioned in the handle portions 112 and 122 is also bent to correspond to each of the handle portions 112 and 122.

The rotary shaft 43 may be formed of a shaft of various materials and various shapes. Therefore, the invention is not limited to the materials and shapes of the rotary shaft 43.

In the dead lock assembly 40, when the user inserts the key 416 to the key module 41 and rotates the key module 41, the rotary shaft 43 is rotated through the rotation transmitter 42, and thereby moving the dead lock member 4.

In the embodiment, the key module 41 is positioned inside the handle portion 112 or 122, and thus, an additional hole for installing the key module 41 is not formed at a window or a door. Since the key module 41 is not exposed to the outside and the key module 41 is not shown at the front, an appearance of the lever type handle is excellent. Also, the key module 41 is positioned at the end portion of the handle portion 112 or 122, and therefore, the key module 41 can be easily operated by the user through using the key 416.

Further, a structure of the dead lock assembly 40 is simplified as the key module 41, the rotation transmitter 42, and the rotary shaft 43. Accordingly, a number of components can be reduced, and the manufacturing cost can be decreased. In addition, it is convenient to assemble and disassemble the dead lock assembly 40.

Furthermore, by unifying the shapes of the key modules 41, 41*a*, and 41*b*, the key module 41 having the key way 410, the key module 41*a* having the groove 410*a* for the coin 416*a* , or the key module 41*b* having the grip portions 410*a* can be freely selected. Also, when the key module 41, 41*a*, or 41*b* is not necessary, the finishing module 41*c* can be used instead of the key module 41, 41*a*, or 41*b*. That is, the key module 41, 41*a*, or 41*b* and/or the finishing module 41*c* can be variously applied according to user's taste, a location of a door, and a use of the door. Therefore, the right of selection of the user can increase, and productivity of producers can be enhanced.

Hereinafter, lock assemblies for lever type handles according to other embodiments of the invention will be described in more detail. Portions that are same as or similar to the portions of the above embodiment will be omitted, and other different portions will be described in more detail.

Figure 5:
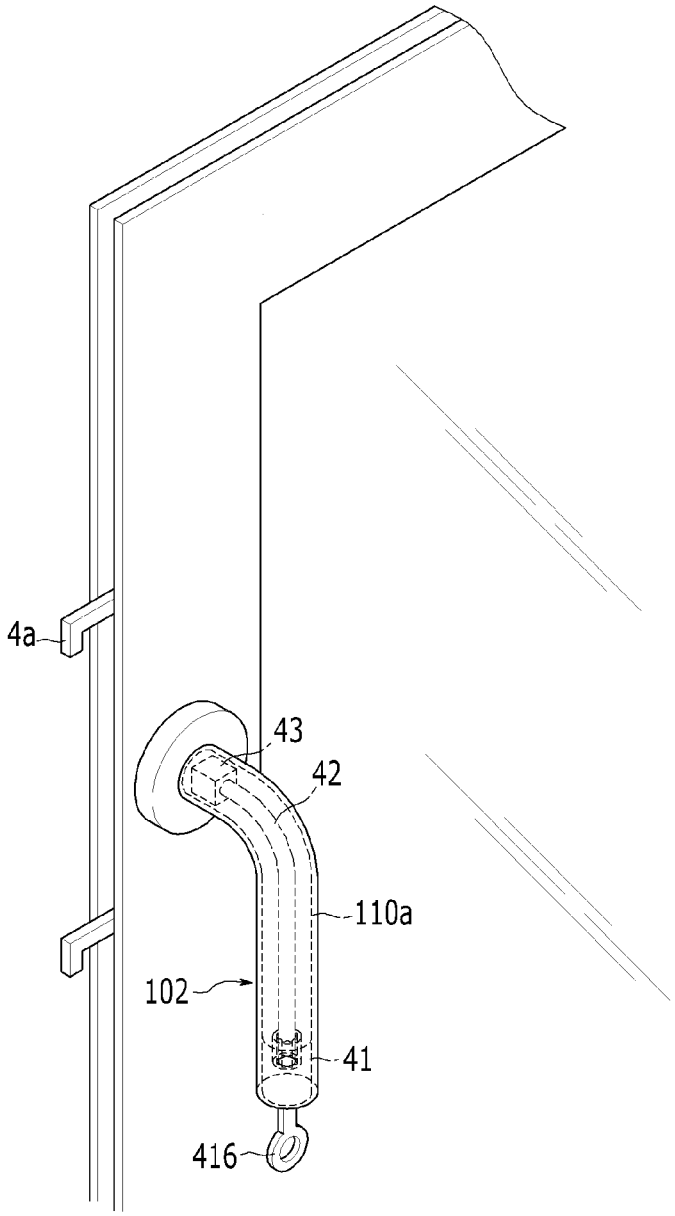
FIG. 5 is a perspective view of a lever type handle including a lock assembly for according to a second embodiment of the invention.

FIG. 5 is a perspective view of a lever type handle including a lock assembly according to a second embodiment of the invention.

Referring to FIG. 5, a lever type handle 102 according to the second embodiment is applied to a sliding door 20 such as a window. That is, in the above embodiment, it is described and shown that the lever type handle is applied to a hinged door. On the other hand, in the second embodiment, a lock assembly for the lever type handle is applied to the sliding door 20. In this instance, handle structures 110*a* may be positioned at both side of the sliding door 20, respectively, or the handle structure 110*a* may be positioned at one side of the sliding door 20.

In the second embodiment, the dead lock member 4*a* positioned inside the sliding door 20 is protruded to maintain the locked state or is inserted into the sliding door 20 to release the locked state, by the rotation of the rotary shaft 43 through the key module 40. Since known various structures may be applied to the structure for making the dead lock member 4*a* of the sliding door 20 protruded from or inserted in the door, the detail descriptions thereof will be omitted.

In FIG. 5, it is exemplified that the key module 41 for using the key 416 is used. However, the invention is not limited thereto. Thus, for the key module 41, the key module41 having the key way 410, the key module 41*a* having the groove 410*a* for the coin 416*a*, the key module 41*b* having the grip portions 410*b*, or the finishing module 41*c*, as shown in FIG. 4 may be used.

Figure 6:
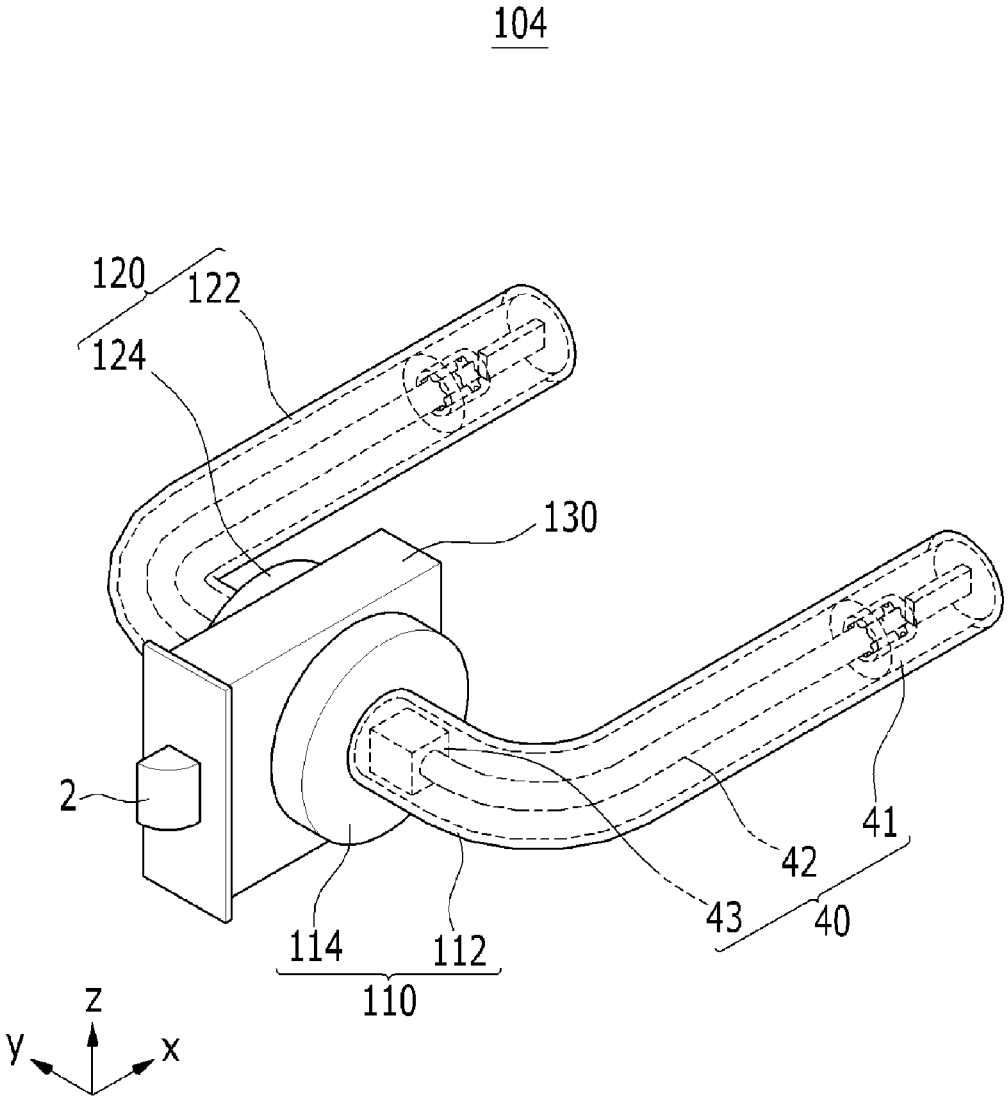
FIG. 6 is a perspective view of a door having a lever type handle including a lock assembly according to a third embodiment of the invention.

FIG. 6 is a perspective view of a door having a lever type handle including a lock assembly according to a third embodiment of the invention.

As shown in FIG. 6, in a lever type handle 104 according to the third embodiment, the dead lock member prevents the rotation of the handle portion 112 or 122, not protruding to the outside. That is, when the key module 41 of a lock assembly for the lever type handle is rotated, the dead lock member (not shown) moves to a position for preventing the rotation of the handle portions 112 and 122. Then, the handle portions 112 and 122 cannot be rotated, and thus, the latch member 2 cannot be inserted into the case portion 103. Thus, the door can be kept closed.

Since known various structures may applied to the structure for preventing the rotation of the handle portions 112 and 122, the detail descriptions thereof will be omitted.

Figure 7:
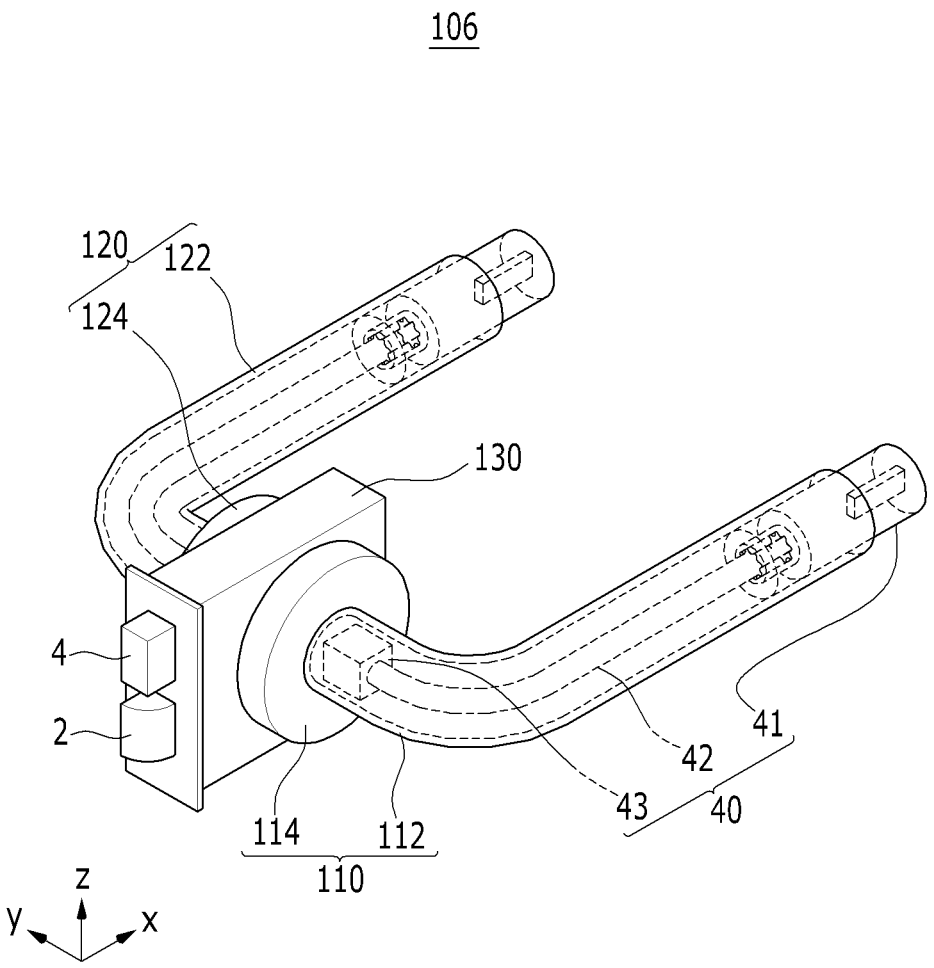
FIG. 7 is a perspective view of a lever type handle having a lock assembly according to a fourth embodiment of the invention.

FIG. 7 is a perspective view of a lever type handle having a lock assembly according to a fourth embodiment of the invention.

Referring to FIG. 7, in a lock assembly 106 according to the embodiment, a part of the key module 41 is positioned in the handle portion 112 or 122, and the other part of the key module 41 is exposed to the outside. Hereby, exposing the part of the key module 41 where the key member like a key is inserted to the outside, the user can easily insert the key into the key module 41. In this instance, since the key module 41 has a shape corresponding to the handle portion 112 or 122, the appearance is not ill although the part of the key module 41 is exposed.

Figure 8:
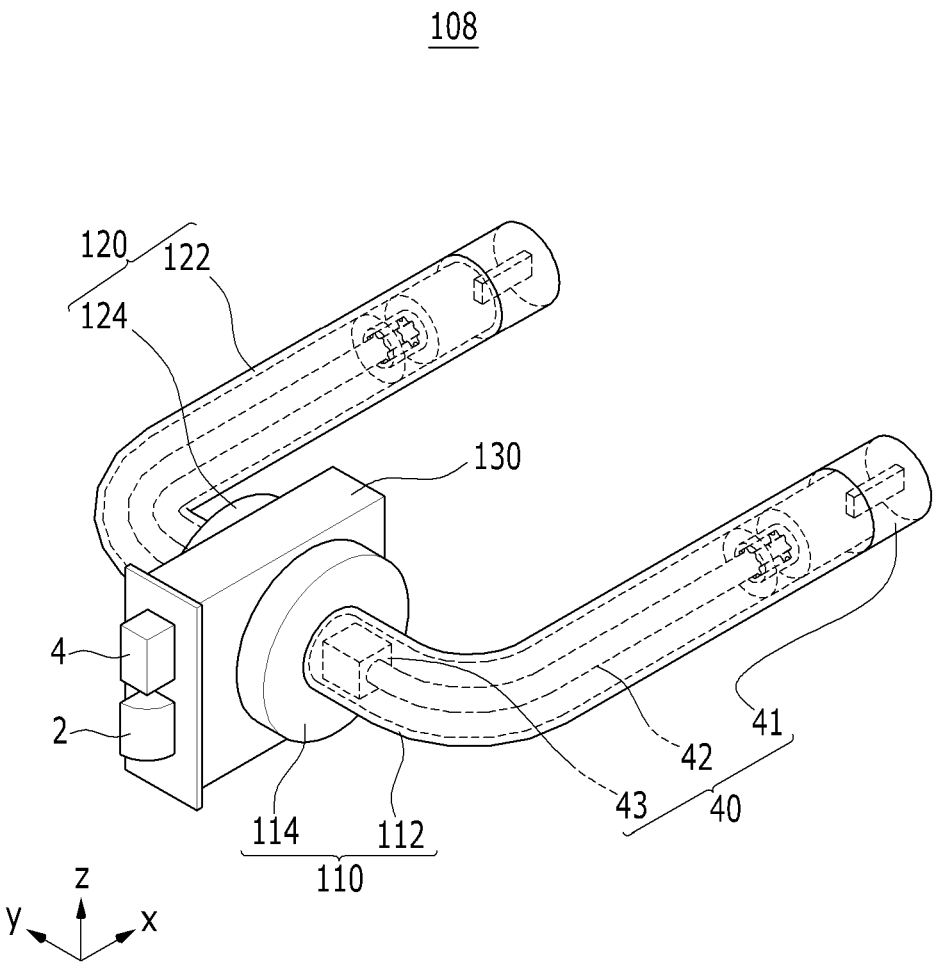
FIG. 8 is a perspective view of a lever type handle having a lock assembly according to a fifth embodiment of the invention.

FIG. 8 is a perspective view of a lever type handle 108 having a lock assembly according to a fifth embodiment of the invention.

It is exemplified that the key module 41 wholly has a uniform diameter in the embodiment shown in FIG. 7. However, the invention is not limited thereto. Therefore, as shown in FIG. 8, a part of the key module 41 positioned outside the handle portion 112 or 122 may have a diameter larger than that of the other part of the key module 41 positioned inside the handle portion 112 or 122. Then, there is no step between the outer surface of the handle portion 112 or 122 and the part of the key module 41 positioned outside the handle portion 112 or 122. Then, the appearance is excellent, and the inconvenience due to the step can be prevented.

As described in the above, the lock assembly for the lever type handle according to the invention can maintain or release the locked state of the door by controlling the movement of the dead lock member 4 or 4*a* protruding to the outside of the door. Also, the lock assembly for the lever type handle according to the invention can maintain or release the locked state of the door by controlling the movement of the latch member 2 by moving the dead lock member to the position for preventing the rotation of the handle portions 112 and 122.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

The invention claimed is:

1. A lock assembly for a lever type handle for opening and closing a door the lock assembly comprising:

a handle portion having a first handle portion coupled to a housing portion and a second handle portion connected to the first handle portion through a bent portion;

a key module rotated by a key member;

a rotary shaft rotated by a rotation of the key module and locking or unlocking the door through a dead lock member; and a rotation transmitter for transmitting the rotation of the key module to the rotary shaft, wherein the key module is positioned at an end portion of the second handle portion, wherein an insertion direction of the key member is parallel to a longitudinal direction of the second handle portion, and wherein the rotation transmitter is bent to correspond to the bent portion of the handle portion.

2. The lock assembly according to claim 1, wherein the rotation transmitter comprises a flexible shaft.

3. The lock assembly according to claim 1, wherein the rotation transmitter has a suspended portion where the rotary shaft is suspended at an end portion of the rotation transmitter.

4. The lock assembly according to claim 1, wherein the dead lock member is protruded from or inserted in the door by the rotation of the rotary shaft.

5. The lock assembly according to claim 1, wherein the key module comprises at least one of a key way, a groove for a coin, and a grip portion.

6. The lock assembly according to claim 1, further comprising:

a fixing portion where the rotation transmitter is fixed, the fixing portion being positioned between the rotation transmitter and the key module, wherein the fixing portion comprises a groove having protrusions and indentations at an inner surface of the fixing portion, and the rotation transmitter is fixed to the groove of the fixing portion.

7. The lock assembly according to claim 6, wherein the key module comprises a depressed portion where the fixing portion is coupled by an interference fit or a tight fit.

8. The lock assembly according to claim 1, wherein the lock assembly is used on a hinged door or a sliding door.

9. The lock assembly according to claim 1, wherein the key module has a cylinder shape.

10. A lever type handle, comprising:

a handle structure positioned outside a door, the handle structure comprising a housing portion mounted adjacent to a door, and a handle portion including a first handle portion rotatably coupled to the housing portion and a second handle portion connected to the first handle portion through a bent portion; and a lock assembly for opening and closing the door by an operation of the handle portion, wherein the lock assembly comprises:

a key module rotated by a key member, the key module being positioned at an end portion of the second handle portion;

a rotary shaft rotated by a rotation of the key module and locking or unlocking the door through a dead lock member; and a rotation transmitter for transmitting the rotation of the key module to the rotary shaft and being bent to correspond to the bent portion of the handle portion.

* * * * *